US005775230A

United States Patent [19]

Joos

[11] Patent Number: 5,775,230

[45] Date of Patent: Jul. 7, 1998

[54] GUIDANCE SYSTEM AND PROCESS FOR CONTROLLING THE LATERAL INCLINATION ON A RAIL VEHICLE

[75] Inventor: Uwe Joos, Rls-Worblingen, Germany

[73] Assignee: Fiat-SIG Schienenfahrzeuge AG, Switzerland

[21] Appl. No.: 687,410

[22] PCT Filed: Dec. 5, 1995

[86] PCT No.: PCT/CH95/00289

§ 371 Date: Oct. 15, 1996

§ 102(e) Date: Oct. 15, 1996

[87] PCT Pub. No.: WO96/17761

PCT Pub. Date: Jun. 13, 1996

[30] Foreign Application Priority Data

Dec. 5, 1994 [EP] European Pat. Off. ..... 94119183

[51] Int. Cl.[6] ..... B61F 5/00

[52] U.S. Cl. ..... 105/199.2

[58] Field of Search ..... 105/171, 199.1, 105/199.2; 280/112.2

[56] References Cited

U.S. PATENT DOCUMENTS

| | | | |
|---|---|---|---|
| 3,717,104 | 2/1973 | Law et al. | 105/199.2 |
| 3,884,437 | 5/1975 | Linderman | 246/182 R |
| 3,902,691 | 9/1975 | Ott | 105/171 |
| 5,295,443 | 3/1994 | Bangtsson et al. | 105/199.2 |
| 5,429,329 | 7/1995 | Wallace et al. | 246/166 |
| 5,564,342 | 10/1996 | Casetta et al. | 105/199.2 |
| 5,636,576 | 6/1997 | Gimenez et al. | 105/199.2 |

FOREIGN PATENT DOCUMENTS

| | | |
|---|---|---|
| 0184960 | 11/1985 | European Pat. Off. . |
| 0271592 | 6/1988 | European Pat. Off. . |
| 2205858 | 8/1972 | Germany . |
| 2252526 | 10/1972 | Germany . |
| 93136792.3 | 9/1993 | Germany . |
| 534391 | 1/1972 | Switzerland . |
| 9000485 | 1/1990 | WIPO . |
| 9100815 | 1/1991 | WIPO . |

*Primary Examiner*—S. Joseph Morano
*Attorney, Agent, or Firm*—Ostrolenk, Faber, Gerb & Soffen, LLP

[57] ABSTRACT

Upon the measurement of lateral acceleration conditions on a rail vehicle and the optimizing accordingly of the inclination of the load-bearing floor, problems result due to time delays between the measurement and the setting as well as to disturbances which are included in the measurement. They are eliminated in the manner that track data relevant to lateral inclination are stored in a track modeling memory (27) together with the actual position (I) detected, the track data relevant at that time or in the future are called up and the precise floor inclination ($\alpha_1$) necessary at the time is calculated (29) as a function of the detected instantaneous speed (9) of the vehicle and set (11).

15 Claims, 4 Drawing Sheets

GUIDANCE SYSTEM AND PROCESS FOR CONTROLLING THE LATERAL INCLINATION ON A RAIL VEHICLE

In rail vehicles, particularly those used for the transportation of persons, it is known to so incline the lateral inclination of the load-bearing floor, i.e. that surface on which a load such as the persons, is carried, as a function of the lateral accelerations which take place upon travel around curves, so that the acceleration resulting from the acceleration due to gravity and the lateral acceleration is applied to the load, insofar as possible, in a direction perpendicular to the load-bearing floor.

The transverse acceleration is dependent on the radius of the curve, the speed of travel, the angle with respect to the truck by which the load-bearing floor is to be set in order to satisfy the above-mentioned conditions and, furthermore, on the banking of the rail.

Various attempts to solve this problem are known. Reference may be had to Federal Republic of Germany Utility Model 93 13 792.3, WO 91/00815, EP-A 0 184 960, DE-OS 22 05 858, and CH-A 534 391.

In this connection, the instantaneous lateral acceleration is fundamentally determined on the vehicle by measurement, for which suitable measuring devices such as a gyroscope, pendulum, etc. are provided on the vehicle. As a function of the instantaneous measurements, the actuator for the lateral inclination of the load-bearing floor is acted on by open-loop or closed-loop control. In this connection, the simplest possibility for adjusting the position is the use of a pendulum the deflection of which is a direct measure of the angle of lateral inclination of the load-bearing floor to be set since, after all, the weight of the load does not form part of the acceleration considerations.

All of these attempts have one essential disadvantage, namely that at the time when conditions of lateral acceleration are detected by measurement, it is already too late to adjust the lateral acceleration of the load-bearing floor. The lateral inclination set always lags behind the actual requirements at the moment. This leads to relatively complicated attempts at solutions by signals which are directed at detecting the commencement of travel around a curve as early as possible, for which, for example, the swinging of the truck is suitable as a measured variable.

The object of the present invention is to create a guidance system which comprises:

a rail vehicle with load-bearing floor mounted for inclination in lateral direction and having an inclination setting device which acts on the load-bearing floor, as well as a setting-device control which adjusts the inclination of the load-bearing floor in such a manner that disturbing influences of lateral acceleration are reduced, and in which the above-indicated disadvantages are eliminated.

Preferred embodiments of this guidance system and the control method of the invention, will be explained below, by way of example, with reference to the figures of the drawing, in which:

FIG. 1 shows, in the form of a simplified signal-flow/function-block diagram, a first possible form of the guidance system of the invention which operates in accordance with the method of the invention on a rail vehicle in accordance with the invention;

FIG. 2 in a view similar to that of FIG. 1, shows a preferred embodiment of the guidance system of the invention;

Figure 1:
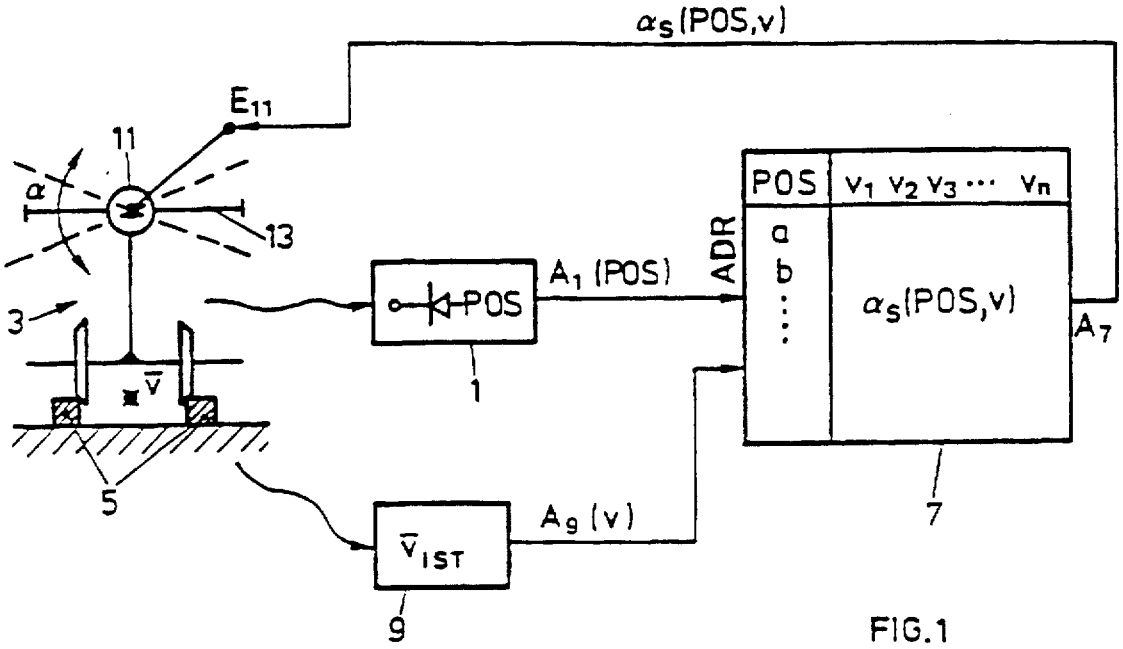
FIG. 1 shows, on basis of a signal-flow/function-block diagram, the guidance system of the invention in a first embodiment, operating in accordance with the method of the invention.

By means of a position detector 1, the instantaneous position of the rail vehicle, shown diagrammatically at 3, on rails 5 is determined. On the detector 1, or the position-detection device 1, there appears, on the output side, a signal $A_1$ (POS) which identifies the actual position (IST) of the vehicle. In a memory device 7, there are stored in tabular form, on the one hand, the positions traveled through by the vehicle 3, for example, on a certain stretch of rail from one place to the other, such as indicated by a, b, . . . , as output address part, as well as the different speeds $v_1, v_2, \ldots, v_n$, with which the vehicle can travel on that stretch, here also as address part.

Inclination setting signals $\alpha_S$ are stored associated directly with the position address parts as well as speed address parts, as shown, and therefore inclination setting signals as a function of the positions as well as of the possible speeds $\alpha_S$ (POS, V). The instantaneous or actual speed (IST) of the vehicle 3 is detected by a speed-detection device 9; on its output side, there appears a signal $A_9(v)$, which identifies the instantaneous speed $V_{IST}$ of the vehicle 3, which signal is also fed to the memory 7. In this connection, the output signals of the position detection device 1 and of the speed detection unit 9 act on address inputs ADR at the memory 7 at which, now, associated inclination setting signals $\alpha_S$(POS, v) are given off, clocked, on the output side, as shown at the output $A_7$, as a function of the instantaneous position and the instantaneous speed of the vehicle 3.

These lateral inclination setting signals $\alpha_S$ are fed to a lateral inclination setting arrangement 11 on the vehicle 3 or on another vehicle of a rail train, namely to a control input $E_{11}$, which setting device displaces the lateral inclination $\alpha$ of a load, such as, for instance, persons to be conveyed, on the vehicle 3 in accordance with the existing requirements. If the actual position is set on one car and the lateral inclination on another car of a train, then the known actual INST-POS position difference is, of course, taken into account. Since for every position along the track 5, the corresponding curve conditions and track banking rate of the line are known, the required lateral inclination angle a of the load-bearing floor 13 can be determined in advance for each such position a, b, . . . for every velocity v of the vehicle and be stored as setting signal $\alpha_S$ in the memory 7.

The utilization of this fact, namely that the rail characteristics are known, makes it possible, in accordance with the present invention, in principle to set the lateral inclination angle a without delay and, as a matter of fact, ideally without delay, as a function of the speed of the vehicle. Differing from lateral acceleration determination by measurement on the vehicle, such as known up to the present time, the sections of the track which are to be traveled over also in the future are known, for instance stored in the memory 7, i.e. the sections of the track not yet passed over by the vehicle which permits immediate control of the inclination "ahead-of-time".

Signal time delays, such as for instance by spring systems between track and acceleration sensors, which can scarcely be excluded in actual use, and disturbing influences on lateral acceleration sensors on the vehicle, such as lateral blows due to switches, etc. which are recorded on measurement arrangements and could improperly lead to a reaction of the lateral inclination setting system, are excluded in the case of the invention since lateral inclination setting system signals are clearly associated with the vehicle positions along the section of the track 5 or determined as a function of its speed.

The invention therefore proceeds from recognition of the fact that a model of the stretch of track exists or can be determined, whether this is given by the actual stretch of the track itself or the recorded and stored characteristic data thereof.

For the position of lateral inclination, the vehicle in question need only be brought in correct position on the model and its instantaneous speed taken into account.

The embodiment in accordance with FIG. 1 is, it is true, possible, but it is extremely wasteful if it is borne in mind that the lateral acceleration is proportional to the square of the instantaneous speed and the speed must be taken into consideration in fine steps along curves. To be sure, the amount of prestored data can be kept minimal for straight stretches of track in the manner that, after passing over a curve, the vehicle can be switched to free travel and need be brought onto the model, and thus locked to it again, only just before the next curve.

In accordance with what has been stated above, the person skilled in the art already has a choice between the most varied embodiments, a few of which will be explained below.

Aside from the lateral inclination setting device 11, all system function units 1, 7 and 9 can be provided, depending on their configuration, on the vehicle 3 or be implemented outside the vehicle. As position detector 1 there can be used, as example of a non-vehicle-supported position detection system, for instance the known satellite-supported GPS system. With such an embodiment, the position detection device which is arranged external to the vehicle 3 can at the same time, by time derivative of the position signal, also form the speed determination device 9.

The position detection device can furthermore be formed, hard-wired, by a vehicle-external position monitoring system for the vehicle 3, or it can be formed by a detector on the vehicle which records, for instance counts, markings provided at corresponding distances apart along the track.

As hard-wired system, a known line conductor system can be used, for instance. Also, for instance, markings which are optically or magnetically detectable from the vehicle, such as for instance used for signal purposes, can be placed along the track and used in order to synchronize the physical actual position of the vehicle with its position on the stored model of the track or to lock the position of the vehicle on the model again exactly with the physical actual position of the vehicle.

The position detection device 1 can, furthermore, be arranged on the vehicle, and be formed for instance by a wheel-revolution counter and thus record the distance traveled, which is synchronized with the physical actual position by being placed in relationship to external markings of the aforementioned type or with fed reference signals at predetermined positions along the track, so that the travel distance measured indicates the actual position of the vehicle. As mentioned, the speed signal can in this case be formed, when the actual position signal is present, by the time derivative thereof.

Figure 2:
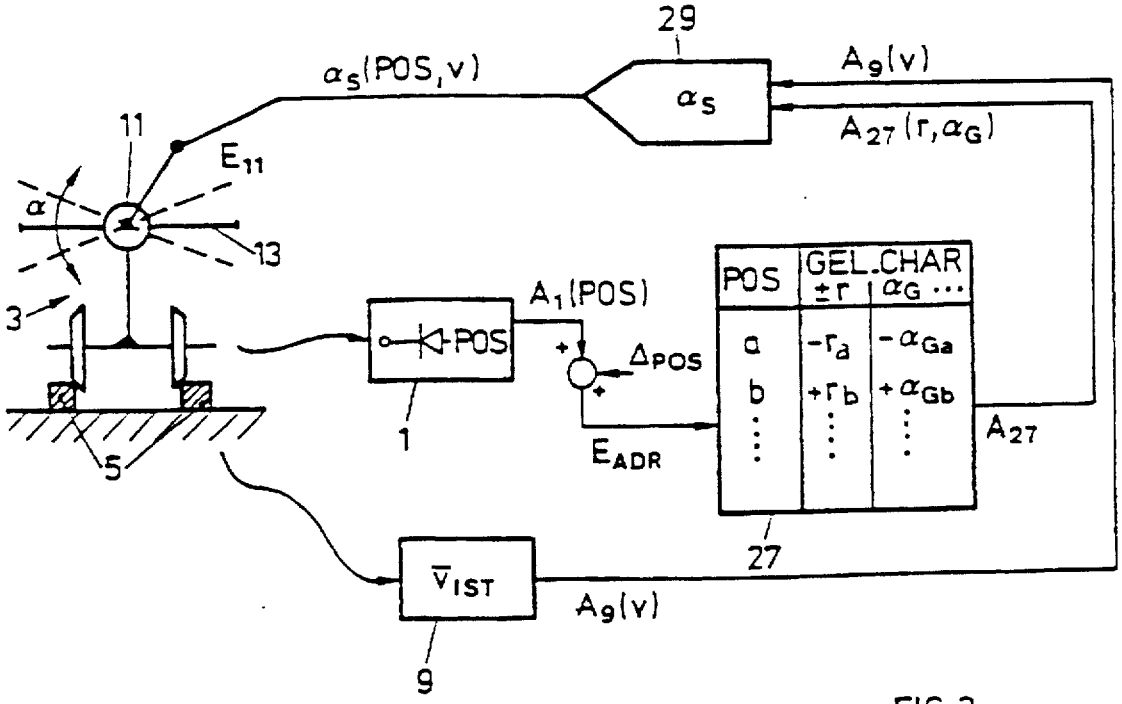

A reduced expenditure of memory compared with FIG. 1 is obtained with a preferred embodiment of the inventive guidance system which operates by the method of the invention and is shown in FIG. 2.

The function blocks and function signals already described with reference to the embodiment shown in FIG. 1 are provided with the same position numerals in FIG. 2.

The output signal $A_1$(POS) of the position detection unit 1 again acts on the address input $E_{ADR}$ of a memory 27 in which, at predetermined positions along the track 5 corresponding to a, b, . . . , track characteristics are stored, in particular radii of curvature r in proper sign of curves, and the track banking $\alpha_G$ prevailing there, also with proper sign. The instantaneous track characteristics called up by the output signal of the position detection unit are fed on the output side of the memory 27, corresponding to the signal $A_{27}(r, \alpha_G)$, to a computing device 29, in the same way as the output signal $A_9(v)$ of the speed detection device 9 corresponding to the instantaneous speed of the vehicle 3. On the basis of known calculation algorithms which reproduce the physical laws, lateral inclination setting signals $\alpha_S$(POS, v) are fed from the computing device 29, on the basis of the track characteristics prevailing at the time as well as the travel speed at the time, to the control input $E_{11}$ of the lateral inclination setting device 11 on the vehicle 3.

Of course, in this case also, the adjustment signals necessary in each case can, as already explained with reference to FIG. 1, be calculated "beforehand", with due consideration of positions still not reached and of the track characteristics present there, if the fact is taken into consideration that the instantaneous speed of the vehicle, in case of sufficiently short distances between the positions a, b, etc. can be taken as constant or calculated by acceleration or delay extrapolation. For this, a $\Delta_{POS}$ which is constant or varies for instance in accordance with the conditions of the curve can be superimposed on the instantaneous position signal.

Thus, for example, on a multi-car train of a given length, the lateral inclination in the front car can be set in accordance with its detected actual position, that of the following car, based on the detected actual position on the front car and with due consideration of the lengthwise distances from the front car to the following car in question. Of course, one can also proceed from the detected actual position of the rear car or of any intermediate car and the inclination of the car load-bearing floor be set forward or rearward in the makeup of the train, taking the corresponding distances apart into account.

With regard to the considerations as to what functions are bound to the vehicle and what ones can be effected externally, as well as with respect to different possibilities for the development of position detection devices and speed detection devices, what has been stated with regard to FIG. 1 applies also with respect to the embodiment shown in FIG. 2.

In the embodiment shown in FIG. 2, only track characteristics as a function of the position on the stretch of track are stored in the memory device 27.

Without basically leaving the functional diagram of FIG. 2, there is now another possible embodiment, which consists of utilizing the stretch of track itself as storage device, on or in which the characteristics of the track are inherently stored. By recognition of this fact, there is now afforded the possibility of optically detecting the track lying in front of the vehicle by means of an imaging device, for instance a video camera or a night-vision device arranged, for instance, on the front of the vehicle, and of determining the track characteristics lying in front of the vehicle by picture evaluation from the stretches of track which are not difficult to discriminate in the picture. Since, in such a case, in which the vehicle itself maintains its instantaneous position and the track characteristics are determined in the instantaneous position of the vehicle, the provision of a position detection device is unnecessary. The detection of the instantaneous speed of the vehicle is effected either in one of the manners described, such as by determination of the speed of rotation of the wheel, or also by rapid evaluation of the sequence of pictures obtained with such an image recording device.

Figure 3:
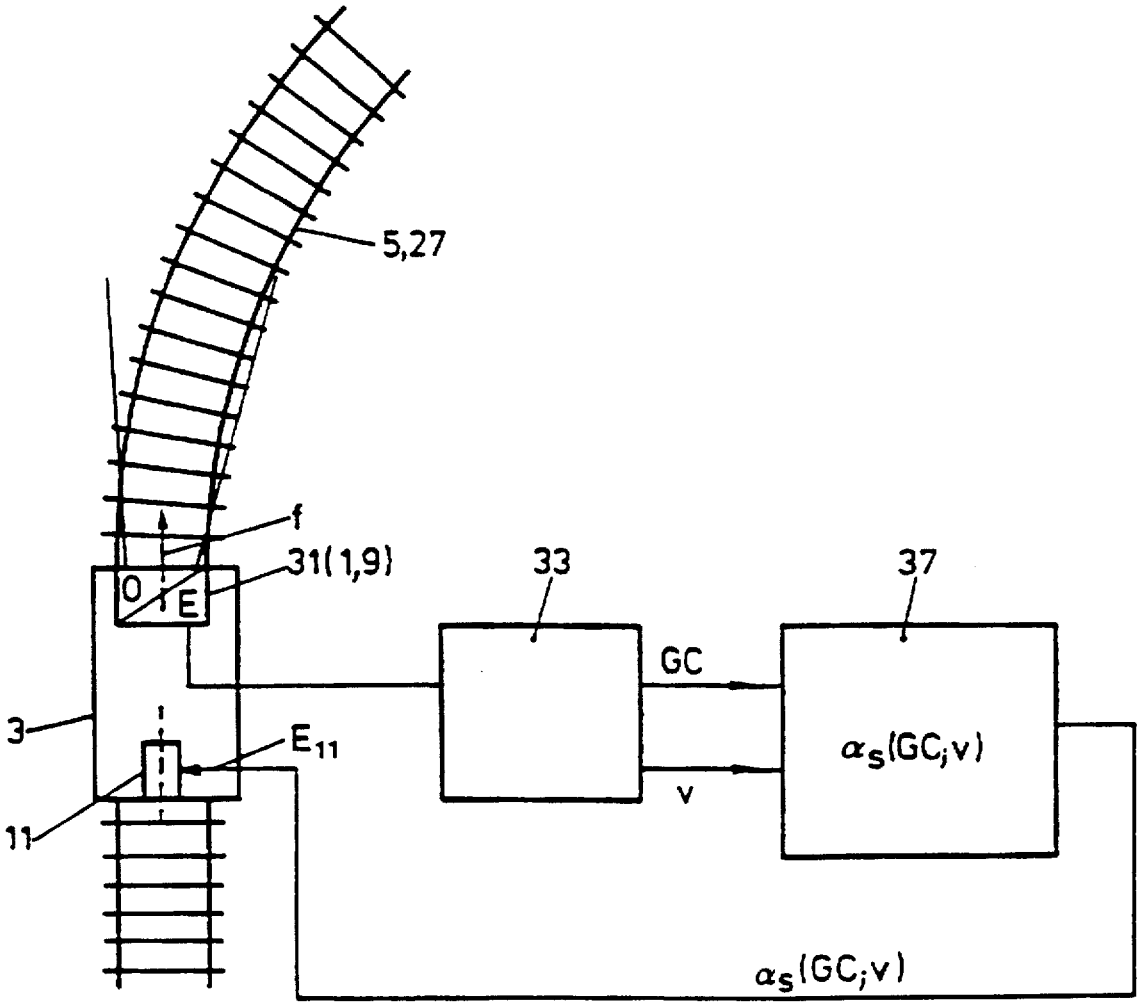
FIG. 3 shows, on the basis of a simplified function-block/signal-flow diagram, another embodiment of the invention, in which the stretch of track for a rail vehicle is itself used as inherent memory.

This procedure is shown diagrammatically in FIG. 3 by another embodiment of the guidance system of the invention. Once again, the same reference numerals as in FIGS. 1 and 2 are used for the same function blocks, signals and system parts, in order to facilitate recognition of the analogy.

The vehicle 3 which is shown here diagrammatically in top view bears on its front, seen in its direction of travel f, an optoelectronic converter 31. During its travel, it takes a picture of the section of the track 5 lying in front of it, which is used at the same time as inherent storage 27 for the track characteristics. The picture obtained with the optoelectronic converter 31 is processed in an image-processing unit 33 on which, in particular, the sequence of track pictures is discriminated and from this there are outputted track characteristics GC, such as the said radii and banking. The instantaneous speed as has already been described, is detected either bound to the vehicle or from outside the vehicle, or else, as is shown in FIG. 3, on the basis of the sequence of pictures of the optoelectronic converter 31.

Thus, in this case, the optoelectronic transducer 31 forms, at the same time, position detector 1 and instantaneous speed detector 9, as indicated by the reference numerals placed within parentheses.

On the output side of the picture processing unit 33, the setting signal $\alpha_S$(GC, v) corresponding to the signal pair GC/v is fed with the track characteristics GC and the instantaneous velocity v to a storage device 37 and again fed to the control input $E_{11}$ of the lateral inclination setting member 11. Preferably however, in this case also, the setting signal is determined from the track characteristics and the instantaneous speed on a computer unit instead of the storage device 37.

The characteristic track data, such as curve radius and track banking, are preferably determined in the manner of a "teach-in" thereby that it is not necessarily these variables themselves but ones directly dependent thereon, such as lateral acceleration and the direction thereof, which are detected during a teach-in run of the vehicle 3 bearing known measuring devices such as gyroscope, pendulum, inclination sensors, etc. and stored, for instance, in the memory 27 of FIG. 2. If the specific teach-in run speed is used as standardizing variable, the data thus obtained can be evaluated together with an actual speed which is standardized in each case to the teach-in speed by the speed detection device 9, as shown in FIG. 2.

It is furthermore proposed, however, that the guidance system of the invention is realized, to connect at least one second guidance system in parallel with the guidance system of the invention in order, on the one hand, to be able to effect a redundancy verification of the setting signals supplied by the two systems for the lateral inclination setting device and, in the case of deviations of the setting signals $\alpha_S$ which exceed a predetermined amount, introducing adequate measures on the vehicle such as, for instance, transferring the side inclination guidance to the second guidance system if the latter is, for instance, more secure against disturbance. The fact that namely a measuring guidance system known for instance per se which is provided as redundant guidance system effects the control of the lateral inclination less efficiently in accordance with the instantaneous requirements is not disturbing since this case occurs only as a case of auxiliary operation.

Figure 4:
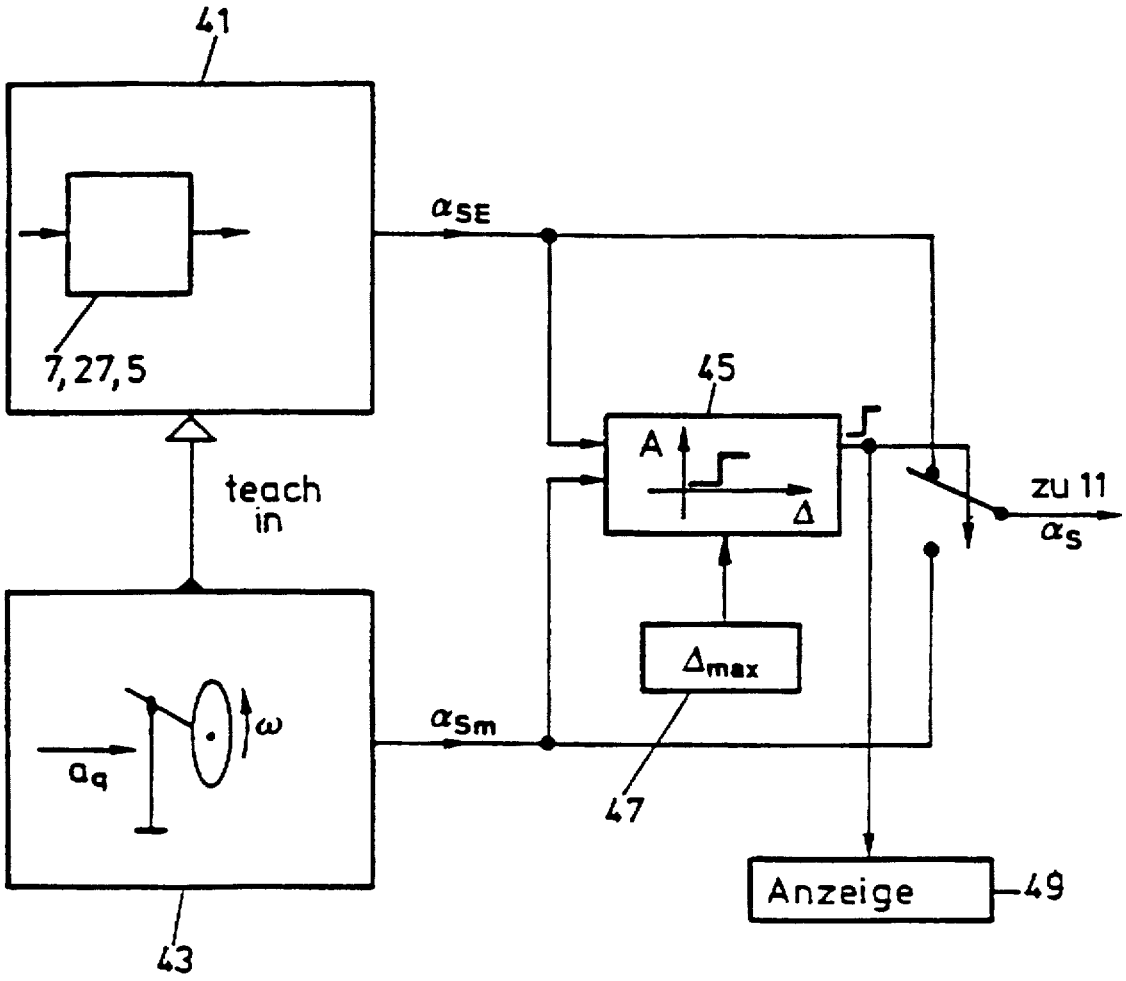
FIG. 4 shows, on basis of a simplified function-block/signal-flow diagram, a further development of the system of the invention, with the addition of a redundancy system.

A redundance guidance of the type mentioned is shown diagrammatically in FIG. 4 in the form of a function block diagram.

In FIG. 4, the guidance system, developed in any way in accordance with the invention, for the delivery of the lateral inclination setting signal $\alpha_S$, here designated $\alpha_{SE}$, is shown diagrammatically in block 41. As characteristic block, the guidance system 41 of the invention comprises a storage of the type 7, 27, 5 shown in FIGS. 1 to 3.

Another guidance system, which possibly differs from the invention, is indicated diagrammatically by block 43 and is based preferably on the detection by measurement of a variable which is related to the lateral acceleration $\alpha_q$, as represented diagrammatically by the gyroscope in block 43. This guidance system also delivers, in the manner specific to this system, a setting signal $\alpha_{SM}$. Both setting signals $\alpha_S$ or these unambiguously determining other signals are compared with each other in a comparison unit 45 as to whether they do not deviate from each other by more than a maximum amount $\Delta_{max}$ which can be predetermined in an entry unit 47. If the two redundant signals $\alpha_{SE}$, $\alpha_{SM}$ differ from each other by more than the predetermined amount, the vehicle 3 can now, for instance, be guided by the more reliable one of the two guidance systems 41, 43, even if the more reliable system is less precise from the standpoint of control technique, in line with the introductory remarks.

When the system 43 detects by measurement the lateral acceleration conditions on the vehicle, such a signal 43, even though far less precise from a control standpoint is used as "auxiliary system" for the lateral inclination control or guidance on the vehicle 3. The comparison unit 45 connects the input $E_{11}$ of the lateral inclination actuator 11 in accordance with FIGS. 1 to 3 to the auxiliary system 43, already known for instance, which is based on the measurement of the lateral acceleration. At the same time, this situation is for instance displayed, as shown at 49 in FIG. 4.

By the provision of the system 43, which acts in said sense as auxiliary system and measures the lateral acceleration or the variables defining it, sensors must necessarily be provided on the vehicle for the detection of lateral acceleration, which sensors can be used in a teach-in phase for the system 41 of the invention in the manner that, as previously described, a stretch is traveled over by the vehicle and the track characteristics detected by measurement are loaded into a memory.

Figure 5:
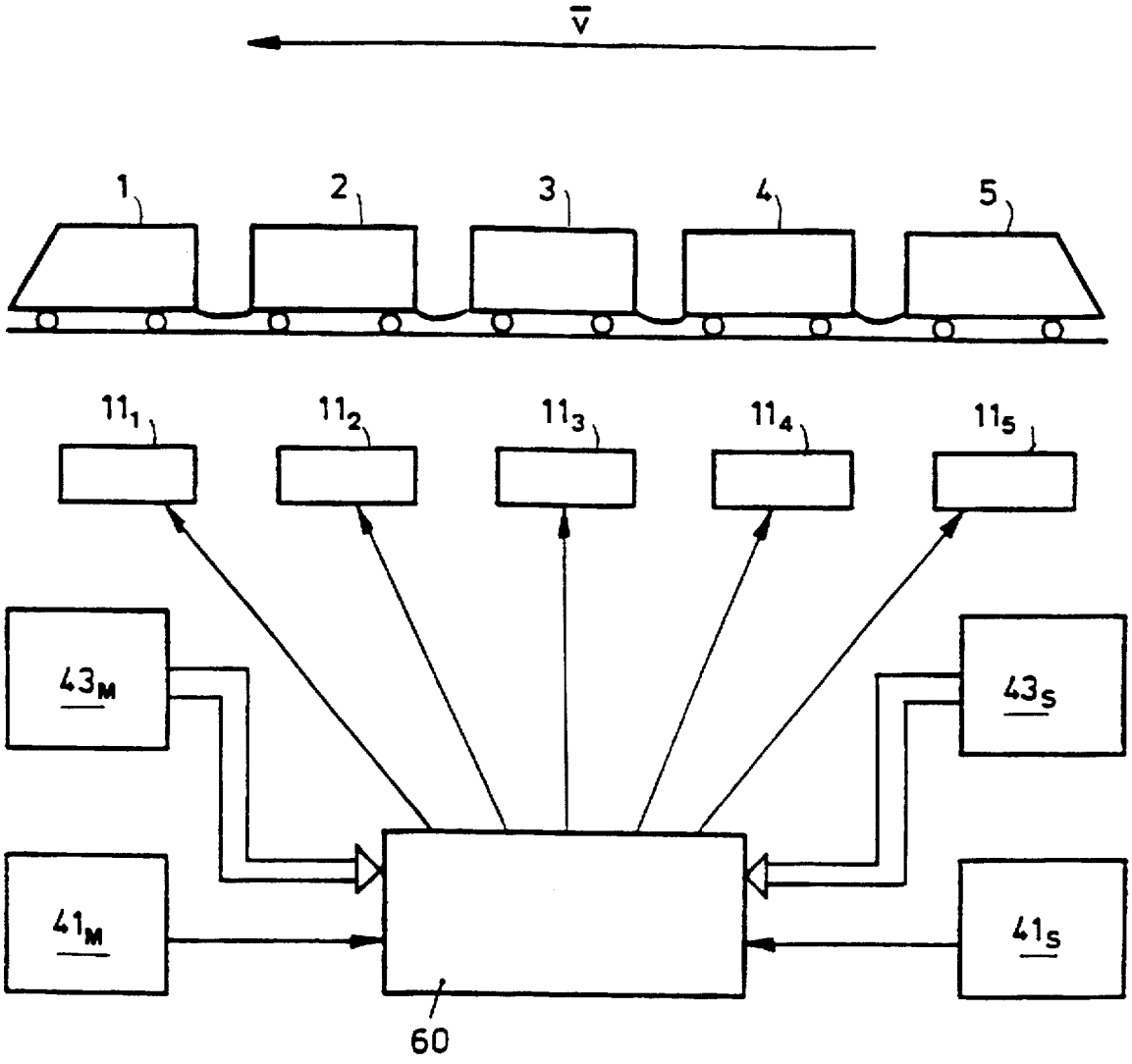
FIG. 5 shows diagrammatically an implementation of two guidance systems of the invention as master and slave, as preferred embodiment of redundant systems.

FIG. 5 shows a train composition with, for instance, motor cars 1 and 5, configured for travel in direction v. Insofar as necessary, each car 1 to 5 has a setting unit 11 for the setting of the lateral inclination of the load-bearing floor, as has been described. On the front car, as seen in the direction of travel v, namely the motor car 1, there is provided a guidance system $43_M$ in accordance with the invention as well as a system $41_M$ based, for instance, on measurement of lateral inclination, as already described with reference to FIG. 4.

For the reversal of the direction of travel, there is provided on the motor car 5, completely symmetrically, a guidance system $43_S$ in accordance with the invention and a system $41_S$ based on measurement of the lateral inclination, as already described with reference to FIG. 4. In the direction of travel shown, the systems on the motor car 1 act as master system (M) and those on the car 5 as slave system (S).

On such a preferred constellation, the lateral inclination guidance is associated as follows with the systems provided:

The master system $43_M$ of the invention supplies the setting signals α for all cars 1 to 5 equipped with lateral inclination control of the type described. The master total system on the car 1 monitors itself, for instance in the manner that the instantaneous setting value for the load-bearing floor on one the cars, given by the system $43_M$ of the invention, is compared with that of the system $41_M$. If these setting signals differ from each other in such a manner that this is no longer plausible, then the control of the load-bearing floor lateral inclinations of all cars 1 to 5 are transferred to the slave system $43_S$ of the invention, as is shown diagrammatically in FIG. 5 by the switch unit 60.

Plausibility is also monitored on the slave total system in the rear car 5, for instance by comparison of the setting signals of the system $43_S$ of the invention and of $41_S$ is based on measurement. If a deviation of these setting signals which is no longer plausible is detected, it is again concluded that the system $43_S$ of the invention is defective, whereupon the system $41_M$ based on measurement takes the lateral inclination controls over, as auxiliary. If this system is also defective, which can be detected, for instance by comparison of truck rotation and lateral inclination setting signal, or if one or more of the lateral inclination setting members 11 is defective, then switching is effected to emergency operation and the train is operated with controlled speed.

Upon reversal of the direction of travel, the systems in car 5 of course take over the master function and the systems in car 1 the slave function.

Although in connection with the description of simple embodiments of the guidance system of the invention, the control of the lateral inclination has in each case been described as a function of instantaneous position and instantaneous speed, it is entirely obvious that because, at least in part, also information effective for the control with respect to a track section to be traveled over in the immediate future is known, i.e. stored, the instantaneous lateral guidance as mentioned can take place by "pre-viewing" of directly following conditions, whereby an optimally gentle guidance of the lateral inclination can be obtained. Problems with respect to time-delayed signal transmissions such as occur in the previously known systems as a result of spring transmissions, sensor inertia, etc. are not present in the procedure in accordance with the invention.

We claim:

1. A guidance system of the type including at least a first rail vehicle with a load bearing floor movably supported in a lateral direction and a setting device for setting the position of lateral inclination of the load-bearing floor, which system comprises:

a position detection device for detecting the actual position of the rail vehicle, the position detecting device, comprising a synchronization device for synchronizing the detected position of the vehicle with the actual physical position of the vehicle;

a speed determining device for determining the actual speed of the rail vehicle; and computing means including a storage device, the computing means being responsive to the position detection device and the speed determining device for generating lateral inclination setting signals and being coupled to the setting device for setting the position of lateral inclination of the load-bearing floor in accordance with such lateral inclination setting signals.

2. A system in accordance with claim 1, wherein the storage device stores a plurality of lateral inclination settings as a function of actual position and actual speed of the rail vehicle.

3. A system in accordance with claim 1, wherein the storage device stores track characteristics as a function of actual position of the rail vehicle.

4. A system in accordance with claim 3, wherein the computing means further includes a computing device responsive to the output of the storage device and the output of the speed determining device for generating lateral inclination setting signals.

5. A system according to claim 1, wherein the storage device and position detection device are formed by a track upon which the rail vehicle rides, and wherein track-picture determination and evaluation devices are provided on the rail vehicle to determine the data on the track.

6. A system according to claim 1, wherein at least one of the position detection device, the speed determination device and the storage device are vehicle-mounted devices.

7. A system according to claim 6, wherein at least one of the position detecting device, the speed determination device and the storage device are non-vehicle mounted devices and connections between the vehicle-mounted and the non-vehicle-mounted devices are effected in a wireless manner.

8. A system according to claim 6, wherein at least one of the position detecting device, the speed determination device and the storage device are non-vehicle mounted devices and connections between the vehicle mounted and the non-vehicle mounted devices are effected via a data-line arrangement.

9. A system according to claim 1, wherein at least one measurement lateral acceleration determination device, the output of which acts on the setting device, is provided on the rail vehicle.

10. A guidance system of the type including at least a first rail vehicle with a load bearing floor movably supported in a lateral direction and a setting device for setting the position of lateral inclination of the load-bearing floor, which system comprises:

a position detection device for detecting the actual position of the rail vehicle;

a speed determining device for determining the actual speed of the rail vehicle;

computing means including a storage device, the computing means being responsive to the position detection device and the speed determining device for generating lateral inclination setting signals and being coupled to the setting device for setting the position of lateral inclination of the load-bearing floor in accordance with such lateral inclination setting signals;

at least one measurement lateral acceleration determination device, the output of which acts on the setting device; and a comparison device, the input of which is connected with the output of the storage device and with the output of the measurement lateral acceleration determination device and the output of which is connected to the setting device, the output of the comparison device switching either the output of the storage device or the output of the measurement lateral acceleration determination device to the setting device.

11. A system according to claim 10, further including at least a second rail vehicle and wherein at least the position detection device is provided on the first rail vehicle and the setting device is provided on the second rail vehicle.

12. A guidance system of the type including at least a first rail vehicle with a load bearing floor movably supported in a lateral direction and a setting device for setting the position of lateral inclination of the load-bearing floor, which system comprises:

a position detection device for detecting the actual position of the rail vehicle;

a speed determining device for determining the actual speed of the rail vehicle;

computing means including a storage device, the computing means being responsive to the position detection device and the speed determining device for generating lateral inclination setting signals and being coupled to the setting device for setting the position of lateral inclination of the load-bearing floor in accordance with such lateral inclination setting signals; and a second rail vehicle having a position detecting device, and that, depending on the direction of travel, one of the first and second rail vehicles acts as master vehicle and the other as slave vehicle, the control of the lateral inclination being switched upon failure of the position detection device on the master vehicle to dependence on the position detection device on the slave vehicle.

13. A method of controlling the lateral inclination of the load-bearing floor of a rail vehicle, which comprises:

(a) determining for a course of the track a desired lateral inclination of the load-bearing floor corresponding the instantaneous position of the vehicle and its instantaneous speed;

(b) adjusting the lateral inclination of the rail vehicle to the desired lateral inclination; and checking the plausibility of the lateral inclination setting signal in accordance with predetermined criteria and, in the event of non-plausibility, transferring adjustment of the lateral inclination to another control method.

14. A method according to claim 13, including storing a model of the course of the track based on the determination made in step (a) in a storage device, the model including instantaneous lateral-inclination-relevant data as a function of the instantaneous position of the vehicle.

15. A method according to claim 13, wherein the lateral-inclination-relevant data of the track are determined by travel over the track.

* * * * *